US007532097B2

(12) United States Patent
Malingowski et al.

(10) Patent No.: US 7,532,097 B2
(45) Date of Patent: May 12, 2009

(54) SLOT MOTOR HOUSING AND CIRCUIT INTERRUPTER INCLUDING THE SAME

(75) Inventors: Richard P. Malingowski, Finleyville, PA (US); William G. Eberts, Coraopolis, PA (US); Mark A. Janusek, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 145 days.

(21) Appl. No.: 11/673,876

(22) Filed: Feb. 12, 2007

(65) Prior Publication Data

US 2008/0191819 A1 Aug. 14, 2008

(51) Int. Cl.
*H01H 9/30* (2006.01)

(52) U.S. Cl. ..... 335/201; 335/156; 335/202; 218/15; 218/34; 218/46; 218/68; 218/76; 218/147

(58) Field of Classification Search ..... 335/156, 335/201–202; 218/15, 34, 46, 68, 76, 147
See application file for complete search history.

(56) References Cited

U.S. PATENT DOCUMENTS 4,220,934 A * 9/1980 Wafer et al. ..... 335/16
4,375,021 A 2/1983 Pardini et al.
4,546,336 A 10/1985 Petrie et al.
4,546,337 A 10/1985 Petrie et al.
4,549,153 A 10/1985 Forsell et al.
4,963,849 A * 10/1990 Kowalczyk et al. ..... 335/201
4,970,482 A 11/1990 Jacobs et al.
5,302,788 A 4/1994 Link et al.
5,694,098 A 12/1997 Mody et al.
6,052,047 A * 4/2000 Malingowski et al. ..... 335/202
6,259,342 B1 * 7/2001 Malingowski et al. ..... 335/202
6,281,459 B1 8/2001 Munsch et al.
6,831,536 B1 12/2004 Zindler
6,970,059 B2 11/2005 Mueller et al.
7,348,514 B2 * 3/2008 Puskar et al. ..... 218/154
7,358,455 B2 * 4/2008 Schaltenbrand et al. ..... 200/401

* cited by examiner

*Primary Examiner*—Elvin G Enad
*Assistant Examiner*—Mohamad A Musleh
(74) *Attorney, Agent, or Firm*—Martin J. Moran

(57) ABSTRACT

A circuit breaker includes a housing, separable contacts, an operating mechanism structured to open and close the separable contacts, a power conductor including a first conductor and a second reverse loop conductor, the second reverse loop conductor carrying one of the separable contacts, and a slot motor. The slot motor includes a first slot motor portion, and a second slot motor portion including a plurality of generally U-shaped slot motor laminations, a first insulative housing portion, and a second insulative housing portion. The first and second insulative housing portions interlock with one another to form a generally U-shaped insulative slot motor housing. The first and second insulative housing portions cooperatively receive the generally U-shaped slot motor laminations.

9 Claims, 6 Drawing Sheets

SLOT MOTOR HOUSING AND CIRCUIT INTERRUPTER INCLUDING THE SAME

BACKGROUND OF THE INVENTION

1. Field of the Invention

The invention relates to electrical switching apparatus, such as, for example, circuit interrupters and, more particularly, to circuit interrupters employing a slot motor. The invention further relates to slot motors. The invention also relates to slot motor housings.

2. Background Information

Circuit interrupters, such as circuit breakers, are employed in diverse capacities in power distribution systems. A circuit breaker may include, for example, a line conductor, a load conductor, a fixed contact and a movable contact, with the movable contact being movable into and out of electrically conductive engagement with the fixed contact. This switches the circuit breaker between an on or closed position and an off or open position, or between the on or closed position and a tripped or tripped off position. The fixed contact is electrically conductively engaged with one of the line and load conductors, and the movable contact is electrically conductively engaged with the other of the line and load conductors. The circuit breaker may also include an operating mechanism having a movable contact arm upon which the movable contact is disposed.

In order to enhance the speed of separation of the separable contacts, the contacts may be disposed within a slot motor, which increases interruption performance. Ring-shaped or loop-shaped slot motors typically have two assemblies, an upper assembly and a lower assembly. Both of the upper and lower assemblies include a corresponding insulative housing and a plurality of plates composed of magnetically permeable material (e.g., steel), which surrounds the separable contacts and the movable contact arm of the circuit breaker. The lower assembly is disposed below the fixed contact. When the power circuit is live, an electrical arc may be drawn between the separable contacts during separation. The electrical current interacts electromagnetically with the slot motor to induce a magnetic field in the magnetic material of the slot motor, which, in turns, interacts with the separating contacts and the movable contact arm to accelerate the contact opening process. Examples of slot motors are disclosed in U.S. Pat. Nos. 4,375,021; 4,546,336; 4,546,337; 4,549,153; 4,970,482; 5,694,098, and 6,281,459.

As shown in FIG. 1, the upper assembly is an inverted U-shaped assembly having a housing assembly 1 and a plurality of steel lamination plates 2, forming a bight portion 3 and two legs 4,5. The upper slot motor assembly is structured to be disposed over the movable contact (not shown) wherein the tips of the upper assembly legs 4,5 contact the lower slot motor assembly (not shown). The upper assembly legs 4,5 have an extended length to accommodate the path of travel of the movable contact arm (not shown). That is, the movable contact (not shown) is disposed between the upper assembly legs 4,5 and as the movable contact moves between the first, open position and the second, closed position, the movable contact moves from a position adjacent to the upper assembly bight portion 3 to a position adjacent the tips of the legs 4,5. Accordingly, the legs 4,5 have a sufficient length to accommodate the path of travel of the movable contact arm.

The one-piece housing assembly 1 is molded from a suitable plastic that may cause warping of this molded component. For example, a relatively large one-piece housing may come out of the mold (not shown) with the legs 4,5 being bent inward or outward, thereby making it difficult to insert the steel lamination plates 2 within the housing assembly 1 and, also, difficult to insert the inverted U-shaped assembly in the base of the circuit breaker (not shown).

Accordingly, there is room for improvement in electrical switching apparatus, such as circuit interrupters, employing a slot motor.

There is further room for improvement in slot motors.

There is also room for improvement in slot motor housings.

SUMMARY OF THE INVENTION

These needs and others are met by embodiments of the invention, which provide two insulative housing portions that are structured to interlock with one another to form a generally U-shaped insulative slot motor housing, and to cooperatively receive a plurality of generally U-shaped slot motor laminations.

In accordance with one aspect of the invention, a slot motor housing comprises: a first insulative housing portion; and a second insulative housing portion, wherein the first and second insulative housing portions are structured to interlock with one another to form a generally U-shaped insulative slot motor housing, and wherein the first and second insulative housing portions are further structured to cooperatively receive a plurality of generally U-shaped slot motor laminations.

Each of the first and second insulative housing portions may include a first flange outer portion having a first end with a plurality of first steps, a second flange outer portion having a second end with a plurality of second steps, and a third inner portion intermediate the first and second flange outer portions. The first end and the first steps of the first flange outer portion of the first insulative housing portion may be structured to interlock with the second end and the second steps of the second flange outer portion of the second insulative housing portion, and the first end and the first steps of the first flange outer portion of the second insulative housing portion may be structured to interlock with the second end and the second steps of the second flange outer portion of the first insulative housing portion.

Each of the first and second insulative housing portions may include a first flange outer portion, a second flange outer portion, and a third inner portion intermediate the first and second flange outer portions, the third inner portion having an end with a plurality of steps. The end and the steps of the third inner portion of the first insulative housing portion may be structured to interlock with the end and the steps of the third inner portion of the second insulative housing portion.

A first one of the steps of the third inner portion of the first insulative housing portion may be structured to overlap a second one of the steps of the third inner portion of the second insulative housing portion, and a first one of the steps of the third inner portion of the second insulative housing portion may be structured to overlap a second one of the steps of the third inner portion of the first insulative housing portion.

As another aspect of the invention, a slot motor portion comprises: a plurality of generally U-shaped slot motor laminations; a first insulative housing portion; and a second insulative housing portion; the first and second insulative housing portions interlock with one another to form a generally U-shaped insulative slot motor housing, and the first and second insulative housing portions cooperatively receive the generally U-shaped slot motor laminations.

As another aspect of the invention, a circuit interrupter comprises: a housing; separable contacts; an operating mechanism structured to open and close the separable contacts; a power conductor comprising a first conductor and a second reverse loop conductor, the second reverse loop conductor carrying one of the separable contacts; and a slot motor comprising: a first slot motor portion, and a second slot motor portion comprising: a plurality of generally U-shaped slot motor laminations, a first insulative housing portion, and a second insulative housing portion, the first and second insulative housing portions interlock with one another to form a generally U-shaped insulative slot motor housing, and the first and second insulative housing portions cooperatively receive the generally U-shaped slot motor laminations.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the terms "generally U-shaped" or "generally U-shape" or "general U-shape" shall mean that the shape of a corresponding structure has the general shape of the letter "U" in which the bottom of such letter or structure is rounded, generally round, square, generally square, or partially round and partially square, or has the general shape of a base member with two leg (or arm) members extending normal or generally normal from the ends of the base member.

As employed herein, the terms "generally L-shaped" or "generally L-shape" or "general L-shape" shall mean that the shape of a corresponding structure has the general shape of the letter "L" in which the bottom of such letter or structure is rounded, generally round, square, generally square, or partially round and partially square, or has the general shape of a base member with one leg (or arm) member extending normal or generally normal from the end of the base member.

The invention is described in association with a circuit breaker having a single pole, although the invention is applicable to a wide range of circuit interrupters having any suitable number of poles (e.g., one; two; three or more).

Figure 2:
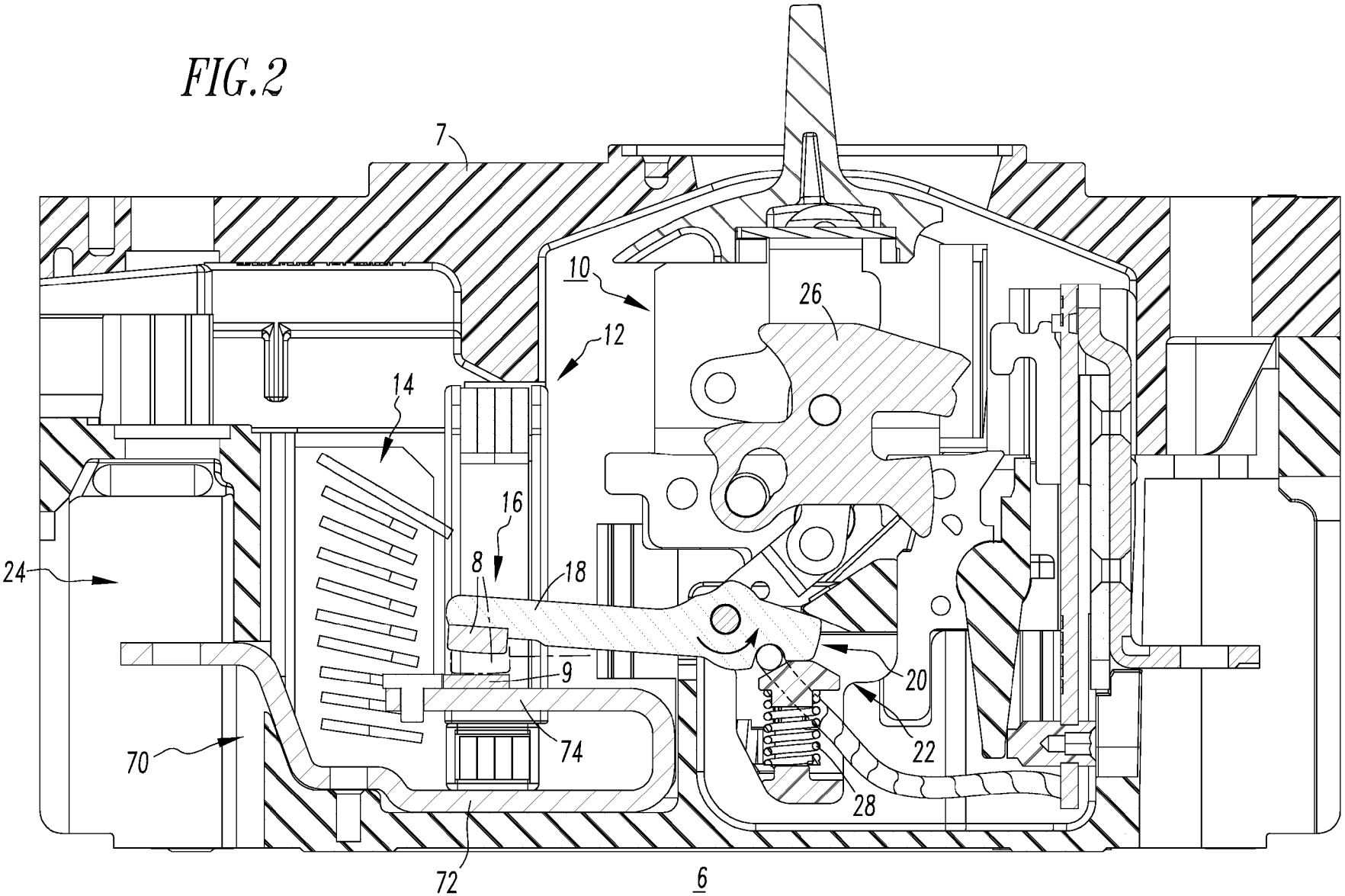
FIG. 2 is a cross-sectional view of a circuit breaker including a loop-shaped slot motor in accordance with an embodiment of the invention.
Figure 5:
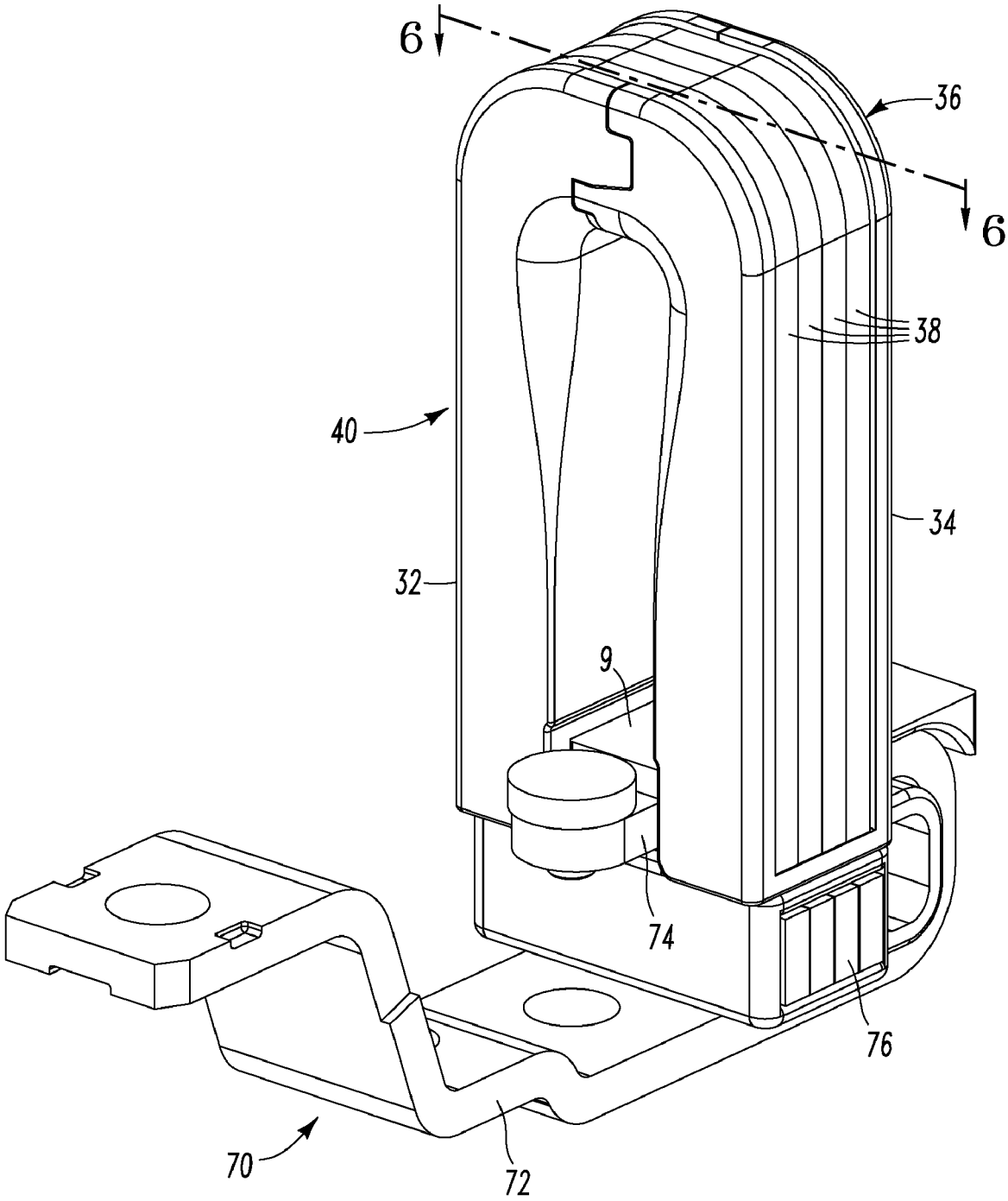
FIG. 5 is an isometric view of a reverse loop power conductor and the loop-shaped slot motor of FIG. 4.

FIG. 2 shows a circuit breaker 6 including a housing 7, separable contacts 8,9 enclosed by the housing 7, and a spring powered operating mechanism 10, which opens the separable contacts 8,9 to interrupt the current through the conductors of an electrical system (not shown) in response to electrical fault conditions. The circuit breaker 6 also includes a loop-shaped slot motor 12 (as best shown in FIG. 5) and an arc chute 14. The separable contacts 8,9 generally comprise one or more movable contacts 8 and one or more corresponding stationary contacts 9. Each movable contact 8 is disposed at or about a first end 16 of a spring-biased movable contact arm 18. The spring-biased movable contact arm 18 is pivotably coupled, at or about its second end 20, to a crossbar 22 of the operating mechanism 10. The crossbar 22 carries the movable contact arms 18 for all of the poles 24 (only one pole 24 is shown) of the circuit breaker 6, and cooperates with a cradle 26 of the circuit breaker operating mechanism 10 to allow for simultaneous opening and closing of the contacts 8,9 in all of the poles 24.

The operating mechanism 10 controls the spring-biased movable contact arm 18 to pivot the movable contact 8 into and out of electrical contact with the corresponding stationary contact 9. A contact arm spring 28 biases the second end 20 of the movable contact arm 18, proximate the operating mechanism crossbar 22, in order to maintain the closed position (shown in phantom line drawing) of the pair of movable and stationary contacts 8,9.

Figure 3:
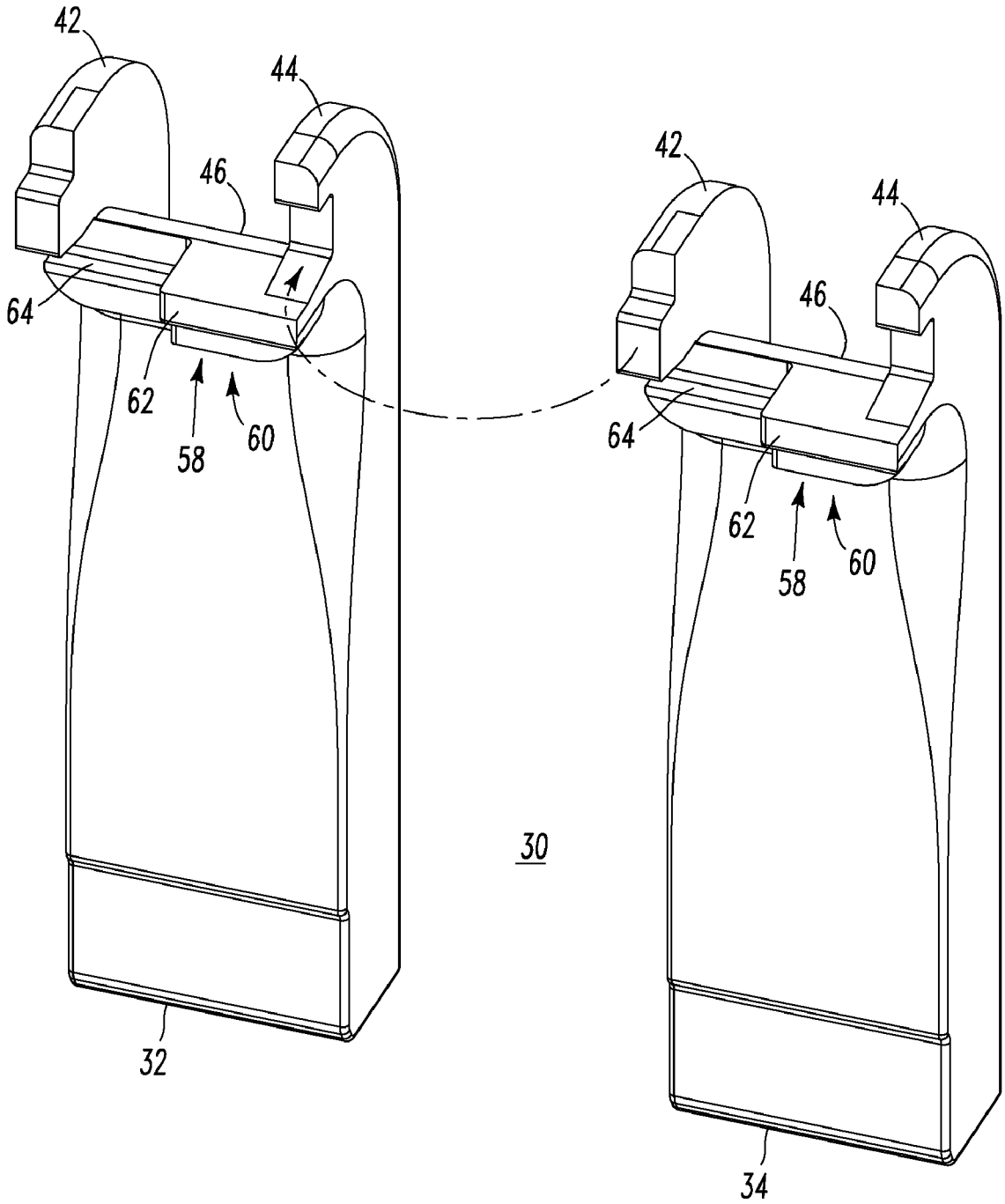
FIG. 3 is an exploded isometric view of a two-piece slot motor housing for the loop-shaped slot motor of FIG. 2.

Referring to FIG. 3, a two-piece slot motor housing 30 for the loop-shaped slot motor 12 of FIG. 2 is shown. The slot motor housing 30 includes a first L-shaped insulative housing portion 32 and a second L-shaped insulative housing portion 34. The first and second insulative housing portions 32,34 are structured to interlock with one another to form a generally U-shaped insulative slot motor housing 36 (as best shown in FIG. 5). The first and second insulative housing portions 32,34 are further structured to cooperatively receive a plurality of generally U-shaped slot motor laminations 38 (as shown in FIGS. 4 and 5).

Figure 4:
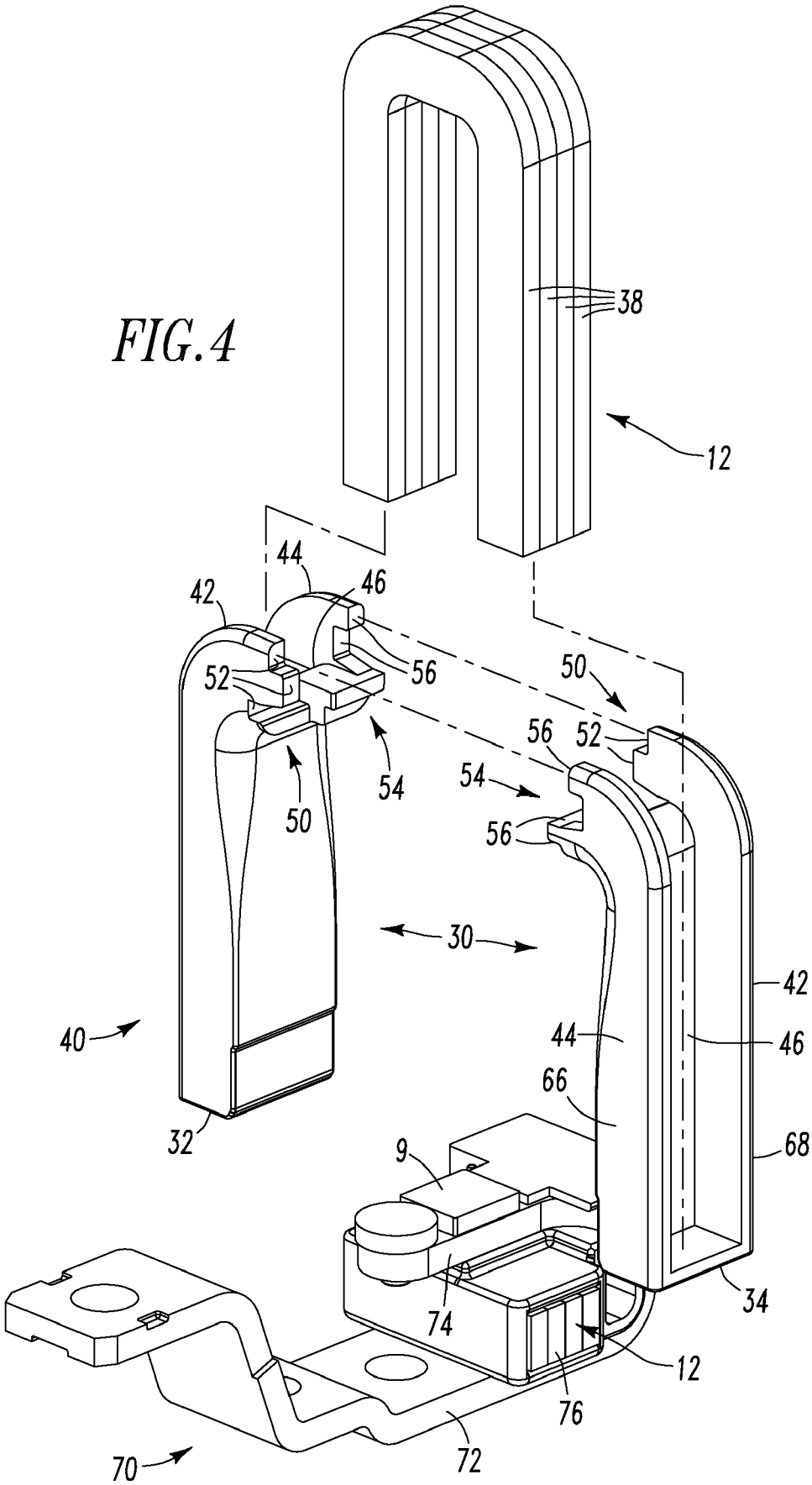
FIG. 4 is an exploded isometric view of a loop-shaped slot motor including the two-piece slot motor housing of FIG. 3.

As shown in FIGS. 4 and 5, an upper slot motor portion 40 includes the generally U-shaped slot motor laminations 38, the first insulative housing portion 32, and the second insulative housing portion 34. The first and second insulative housing portions 32,34 interlock with one another to form the generally U-shaped insulative slot motor housing 30. The first and second insulative housing portions 32,34 cooperatively receive the same generally U-shaped slot motor laminations 38.

Referring to FIGS. 3 and 4, each of the first and second insulative housing portions 32,34 includes a first flange outer portion 42, a second flange outer portion 44 and a third inner portion 46 intermediate the first and second flange outer portions 42,44. The third inner portion 46 of each of the housing portions 32,34 is structured to receive a portion of the same generally U-shaped slot motor laminations 38.

EXAMPLE 1

The first insulative housing portion 32 is preferably symmetrical or identical to the second insulative housing portion 34.

EXAMPLE 2

The housing portions 32,34 are preferably made of molded plastic, such as, for example and without limitation, cellulose-filled melamine formaldehyde. Preferably, the housing portions 32,34 are structured to outgas responsive to an arc (not shown) when the operating mechanism 10 opens the energized separable contacts 8,9 of FIG. 2.

EXAMPLE 3

Each of the first and second insulative housing portions 32,34 includes the first flange outer portion 42 having a first end 50 with a plurality of first steps 52, the second flange outer portion 44 having a second end 54 with a plurality of second steps 56, and the third inner portion 46 intermediate the first and second flange outer portions 42,44. For the pair of the housing portions 32,34, the first end 50 and the first steps 52 of the first flange outer portion 42 of the housing portion 32 are structured to interlock with the second end 54 and the second steps 56 of the second flange outer portion 44 of the housing portion 34, and the first end 50 and the first steps 52 of the first flange outer portion 42 of the housing portion 34 are structured to interlock with the second end 54 and the second steps 56 of the second flange outer portion 44 of the housing portion 32. The first and second steps 52,56, when interlocked as shown in FIG. 5, prevent the pair of housing portions 32,34 from "toeing-in" during insertion of the upper slot motor portion 40 into the molded base of the circuit breaker housing 7.

EXAMPLE 4

The third inner portion 46 of each of the first and second insulative housing portions 32,34 has an end 58 with a plurality of steps 60. The end 58 and the steps 60 of the third inner portion 46 of the first insulative housing portion 32 are structured to interlock with the end 58 and the steps 60 of the third inner portion 46 of the second insulative housing portion 34.

EXAMPLE 5

Figure 6:
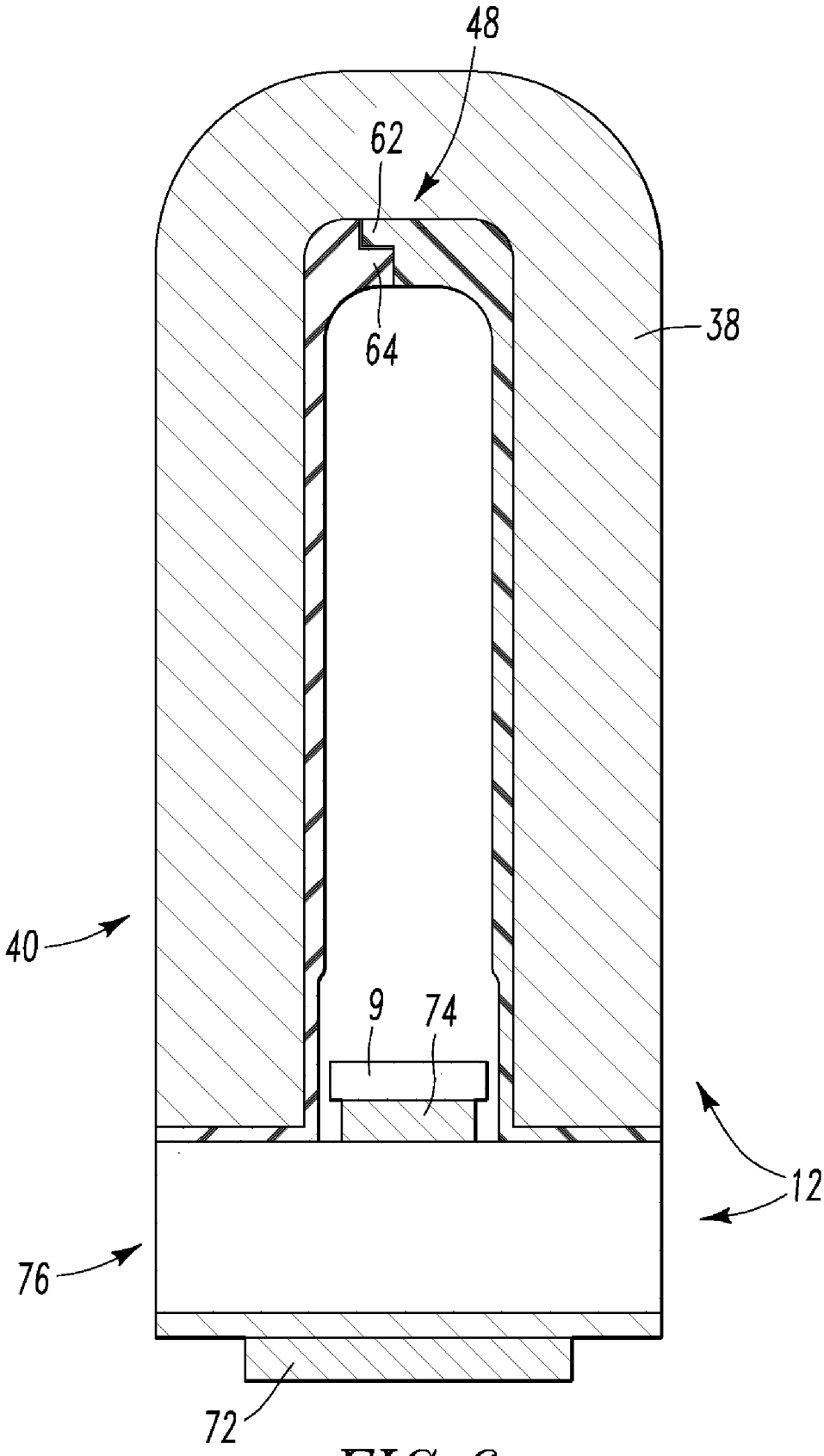
FIG. 6 is a cross-sectional view along lines 6-6 of FIG. 5.

Referring to FIGS. 3 and 6, a first one 62 of the steps 60 of the third inner portion 46 of the first insulative housing portion 32 is structured to overlap a second one 64 of the steps 60 of the third inner portion 46 of the second insulative housing portion 32. Similarly, a first one 62 of the steps 60 of the third inner portion 46 of the second insulative housing portion 34 is structured to overlap a second one 64 of the steps 60 of the third inner portion 46 of the first insulative housing portion 32.

EXAMPLE 6

As shown in FIG. 4, there are flanges 66,68 on both the line and load sides of the upper slot motor portion 40. These flanges 66,68 enhance circuit breaker dielectric and interruption performance. The flanges 66,68 are the exposed plastic faces of the slot motor housing 30 that face the line and load sides of the circuit breaker 6. These protect and insulate both sides of the steel slot motor laminations 38.

EXAMPLE 7

FIG. 5 shows the reverse loop power conductor 70 (FIG. 2) and the loop-shaped slot motor 12 of FIG. 4. The circuit breaker 6 includes the power conductor 70 (e.g., a "reverse loop") having a first conductor 72 and a second reverse loop conductor 74, and the slot motor 12. The second reverse loop conductor 74 carries the stationary contact 9. The slot motor 12 has a conventional base 76 (e.g., without limitation, bight portion) that is disposed between the first conductor 72 and the second reverse loop conductor 74.

EXAMPLE 8

Figure 1:
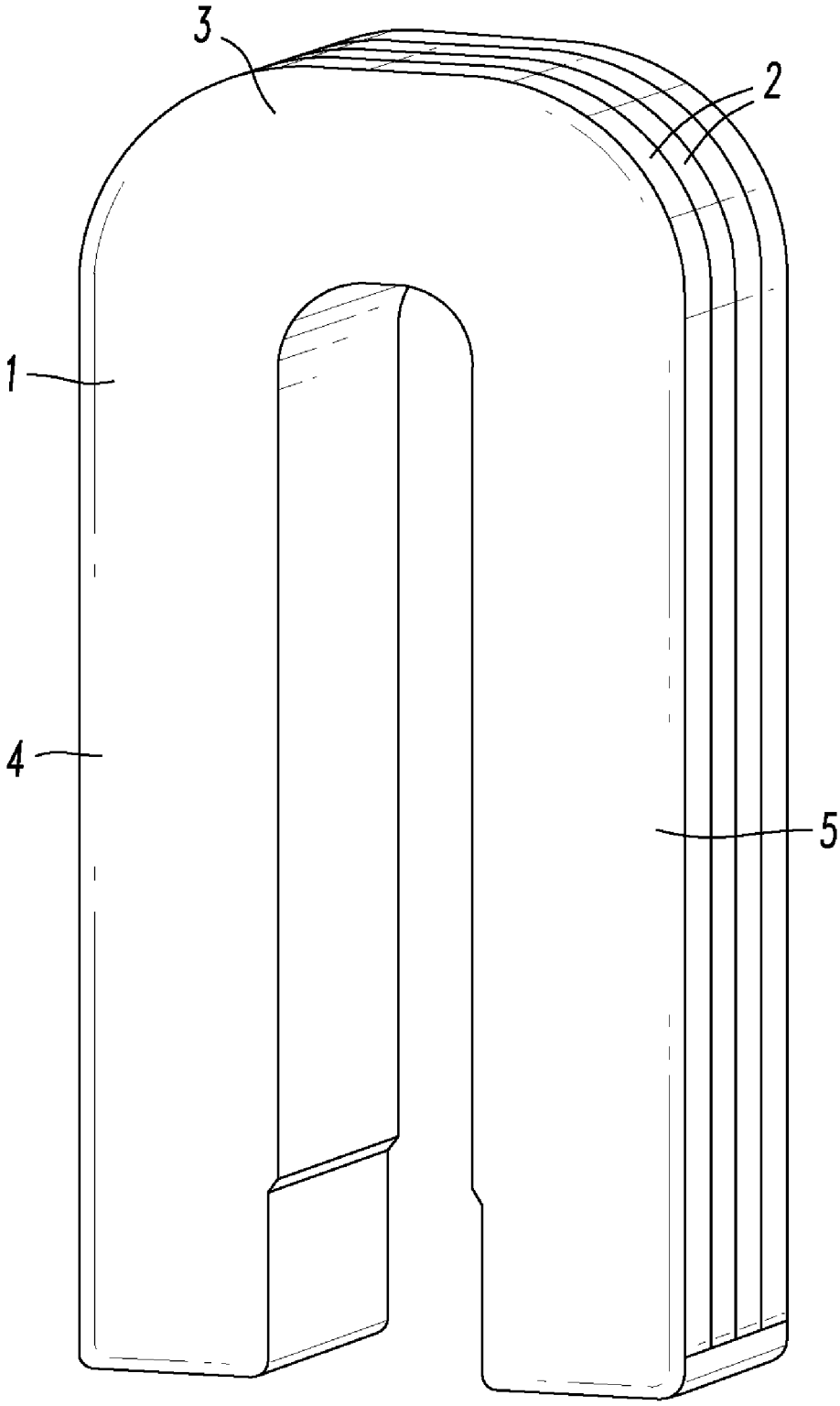
FIG. 1 PRIOR ART
FIG. 1 is an isometric view of an upper slot motor assembly.

As compared to the relatively larger one-piece molded slot motor housing 1 of FIG. 1, FIG. 5 shows the upper slot motor portion 40 made from two relatively smaller housing portions 32,34. These relatively smaller components employ stepped interlocking, as opposed to a flat interface (not shown) between the components, in order to better insulate the slot motor laminations 38 from arcing. The stepped interlock cross-section 48 is shown, for example, in FIG. 6. The relatively longer path on this stepped interlock cross-section 48, as opposed to a straight vertical line for a flat interface (not shown), provides additional distance that an arc (not shown) must traverse through the assembled upper slot motor portion 40 in order to reach the steel slot motor laminations 38 (FIGS. 4 and 5).

EXAMPLE 9

The disclosed two-piece slot motor housing 30 solves the problem of "difficult" plastics causing warping. The molding of the relatively smaller first and second insulative housing portions 32,34 yields relatively straighter parts. A relatively large one-piece housing would come out of the mold (not shown) with the legs of the U-shape being bent inward or outward, thus, making it difficult to insert lamination steel, such as 38, within. Also, the resulting assembly could be difficult to insert in the base of the circuit breaker 6 (FIG. 2). The disclosed stepped interlocking (FIGS. 3-5) of the first and second insulative housing portions 32,34 eases installation of the upper slot motor portion 40 into the circuit breaker 6.

EXAMPLE 10

Molding the example first and second insulative housing portions 32,34 of the two-piece slot motor housing 30 enables the use of plastics, such as, for example and without limitation, cellulose-filled melamine formaldehyde that gives off relatively high amounts of gasses during molding. These types of materials are desired for their performance enhancing qualities on short circuit testing of the example circuit breaker 6. These gasses need to be vented from the mold (not shown) to prevent "no fill" conditions. The disclosed configuration allows proper venting to be incorporated. It is believed that such a housing geometry molded as one-piece would be virtually impossible in mass production because of the venting required and the lack of areas to place it.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A slot motor housing comprising:

a first insulative housing portion;

a second insulative housing portion, wherein said first and second insulative housing portions are structured to interlock with one another to form a generally U-shaped insulative slot motor housing;

wherein said first and second insulative housing portions are further structured to cooperatively receive a plurality of generally U-shaped slot motor laminations; and wherein each of said first and second insulative housing portions includes a first flange outer portion having a first end with a plurality of first steps, a second flange outer portion having a second end with a plurality of second steps, and a third inner portion intermediate said first and second flange outer portions; wherein the first end and the first steps of said first flange outer portion of said first insulative housing portion are structured to interlock with the second end and the second steps of said second flange outer portion of said second insulative housing portion; and wherein the first end and the first steps of said first flange outer portion of said second insulative housing portion are structured to interlock with the second end and the second steps of said second flange outer portion of said first insulative housing portion.

2. A slot motor housing comprising:

a first insulative housing portion;

a second insulative housing portion;

wherein said first and second insulative housing portions are structured to interlock with one another to form a generally U-shaped insulative slot motor housing;

wherein said first and second insulative housing portions are further structured to cooperatively receive a plurality of generally U-shaped slot motor laminations; and wherein each of said first and second insulative housing portions includes a first flange outer portion, a second flange outer portion, and a third inner portion intermediate said first and second flange outer portions, said third inner portion having an end with a plurality of steps; and wherein the end and the steps of the third inner portion of said first insulative housing portion are structured to interlock with the end and the steps of the third inner portion of said second insulative housing portion.

3. The slot motor housing of claim 2 wherein a first one of the steps of the third inner portion of said first insulative housing portion is structured to overlap a second one of the steps of the third inner portion of said second insulative housing portion; and wherein a first one of the steps of the third inner portion of said second insulative housing portion is structured to overlap a second one of the steps of the third inner portion of said first insulative housing portion.

4. A slot motor portion comprising:

a plurality of generally U-shaped slot motor laminations;

a first insulative housing portion;

a second insulative housing portion;

wherein said first and second insulative housing portions interlock with one another to form a generally U-shaped insulative slot motor housing;

wherein said first and second insulative housing portions cooperatively receive said generally U-shaped slot motor laminations; and wherein each of said first and second insulative housing portions includes a first flange outer portion, a second flange outer portion, and a third inner portion intermediate said first and second flange outer portions, said third inner portion having an end with a plurality of steps; and wherein the end and the steps of the third inner portion of said first insulative housing portion interlocks with the end and the steps of the third inner portion of said second insulative housing portion,

5. The slot motor portion of claim 4 wherein a first one of the steps of the third inner portion of said first insulative housing portion overlaps a second one of the steps of the third inner portion of said second insulative housing portion; and wherein a first one of the steps of the third inner portion of said second insulative housing portion overlaps a second one of the steps of the third inner portion of said first insulative housing portion.

6. A slot motor portion comprising:

a plurality of generally U-shaped slot motor laminations;

a first insulative housing portion;

a second insulative housing portion;

wherein said first and second insulative housing portions interlock with one another to form a generally U-shaped insulative slot motor housing;

wherein said first and second insulative housing portions cooperatively receive said generally U-shaped slot motor laminations; and wherein each of said first and second insulative housing portions includes a first flange outer portion having a first end with a plurality of first steps, a second flange outer portion having a second end with a plurality of second steps, and a third inner portion intermediate said first and second flange outer portions; wherein the first end and the first steps of said first flange outer portion of said first insulative housing portion interlocks with the second end and the second steps of said second flange outer portion of said second insulative housing portion; and wherein the first end and the first steps of said first flange outer portion of said second insulative housing portion interlocks with the second end and the second steps of said second flange outer portion of said first insulative housing portion.

7. A circuit interrupter comprising:

a housing;

separable contacts;

an operating mechanism structured to open and close said separable contacts;

a power conductor comprising a first conductor and a second reverse loop conductor, said second reverse loop conductor carrying one of said separable contacts;

a slot motor comprising:

a first slot motor portion;

a second slot motor portion comprising:

a plurality of generally U-shaped slot motor laminations;

a first insulative housing portion;

a second insulative housing portion;

wherein said first and second insulative housing portions interlock with one another to form a generally U-shaped insulative slot motor housing;

wherein said first and second insulative housing portions cooperatively receive said generally U-shaped slot motor laminations; and wherein each of said first and second insulative housing portions includes a first flange outer portion, a second flange outer portion, and a third inner portion intermediate said first and second flange outer portions, said third inner portion having an end with a plurality of steps; and wherein the end and the steps of the third inner portion of said first insulative housing portion interlocks with the end and the steps of the third inner portion of said second insulative housing portion.

8. The circuit interrupter of claim 7 wherein a first one of the steps of the third inner portion of said first insulative housing portion overlaps a second one of the steps of the third inner portion of said second insulative housing portion; and wherein a first one of the steps of the third inner portion of said second insulative housing portion overlaps a second one of the steps of the third inner portion of aid first insulative housing portion.

9. A circuit interrupter comprising:

a housing;

separable contacts;

an operating mechanism structured to open and close said separable contacts;

a power conductor comprising a first conductor and a second reverse loop conductor, said second reverse loop conductor carrying one of said separable contacts;

a slot motor comprising:

a first slot motor portion;

a second slot motor portion comprising:

a plurality of generally U-shaped slot motor laminations;

a first insulative housing portion;

a second insulative housing portion;

wherein said first and second insulative housing portions interlock with one another to form a generally U-shaped insulative slot motor housing;

wherein said first and second insulative housing portions cooperatively receive said generally U-shaped slot motor laminations; and wherein each of said first and second insulative housing portions includes a first flange outer portion having a first end with a plurality of first steps, a. second flange outer portion having a second end with a plurality of second steps, and a third inner portion intermediate said first and second flange outer portions; wherein the first end and the first steps of said first flange outer portion of said first insulative housing portion interlocks with the second end and the second steps of said second flange outer portion of said second insulative housing portion; and wherein the first end and the first steps of said first flange outer portion of said second insulative housing portion interlocks with the second end and the second steps of said second flange outer portion of said first insulative housing portion.

* * * * *